US005954956A

United States Patent [19]

Lutz et al.

[11] Patent Number: 5,954,956

[45] Date of Patent: Sep. 21, 1999

[54] MODULAR SCREEN CYLINDER AND A METHOD FOR ITS MANUFACTURE

[75] Inventors: Mark S. Lutz, West Allis; Dennis G. Purton, Pewaukee; Matthew R. Soik, Muskego, all of Wis.

[73] Assignee: J&L Fiber Services, Waukesha, Wis.

[21] Appl. No.: 08/897,541

[22] Filed: Jul. 22, 1997

[51] Int. Cl.[6] ..... B01D 29/31; B01D 29/37; B01D 39/10

[52] U.S. Cl. ..... 210/232; 210/415; 210/497.01; 209/273; 209/306; 209/397; 209/399; 209/406

[58] Field of Search ..... 210/415, 497.01, 210/232; 209/273, 306, 397, 399, 406

[56] References Cited

U.S. PATENT DOCUMENTS

| | | | |
|---|---|---|---|
| 438,822 | 10/1890 | Philion . | |
| 1,151,131 | 8/1915 | Starliper . | |
| 2,116,584 | 5/1938 | Shelby . | |
| 2,353,444 | 7/1944 | Conradty et al. . | |
| 2,391,302 | 12/1945 | Evans . | |
| 3,091,844 | 6/1963 | Laine . | |
| 3,217,386 | 11/1965 | Clendening, Jr. . | |
| 3,339,731 | 9/1967 | Merges . | |
| 3,387,708 | 6/1968 | Salomon et al. . | |
| 3,399,516 | 9/1968 | Hough . | |
| 3,742,566 | 7/1973 | Reinhardt et al. . | |
| 4,074,985 | 2/1978 | Willas . | |
| 4,213,823 | 7/1980 | Wittig et al. . | |
| 4,264,438 | 4/1981 | Frejborg . | |
| 4,316,768 | 2/1982 | Goddard . | |
| 4,348,284 | 9/1982 | Peer et al. . | |
| 4,379,729 | 4/1983 | Frykhult | 210/232 |
| 4,396,502 | 8/1983 | Justus . | |
| 4,462,900 | 7/1984 | Matthew . | |
| 4,538,734 | 9/1985 | Gill . | |
| 4,657,079 | 4/1987 | Nagaoka . | |
| 4,663,030 | 5/1987 | Chupka et al. . | |
| 4,699,324 | 10/1987 | Ahs . | |
| 4,703,860 | 11/1987 | Gobel et al. . | |
| 4,818,403 | 4/1989 | Nagaoka . | |
| 4,846,971 | 7/1989 | Lamont . | |
| 4,857,180 | 8/1989 | Eriksson . | |
| 4,954,221 | 9/1990 | Reinhall et al. . | |
| 4,954,249 | 9/1990 | Gero et al. . | |
| 4,969,999 | 11/1990 | Riddell . | |
| 4,972,960 | 11/1990 | Bielagus . | |
| 4,981,583 | 1/1991 | LeBlanc . | |
| 5,009,774 | 4/1991 | LeBlanc . | |
| 5,011,065 | 4/1991 | Musselmann . | |
| 5,023,986 | 6/1991 | Gero et al. . | |
| 5,041,212 | 8/1991 | Gero et al. . | |
| 5,041,214 | 8/1991 | Gero et al. . | |
| 5,069,279 | 12/1991 | Nagaoka . | |

(List continued on next page.)

FOREIGN PATENT DOCUMENTS

| | | |
|---|---|---|
| 2178683 | 4/1997 | Canada . |
| WO 90/12147 | 10/1990 | WIPO . |
| WO 98/14658 | 4/1998 | WIPO . |

OTHER PUBLICATIONS

J&L Fiber Services Brochure, "J&L RSC™ Screen Cylinder".

*Primary Examiner*—Thomas M. Lithgow
*Attorney, Agent, or Firm*—Nilles & Nilles S.C.

[57] ABSTRACT

An apparatus and method for screening wood pulp and other fibrous fluid suspensions. The apparatus and method relate to rebuildable, modular screen cylinders for screening thick pulp slurry in pulp and paper applications. The screen sections of the modular screen cylinder of the present invention are of a nonwelded construction. A lap joint according to the present invention is provided in each screen section connecting the ends of the individual sections when the screen sections are rolled into cylindrical shape. As a result, the lap joint of the current invention provides for a nonwelded, modular screen cylinder which is less expensive to manufacture and provides for increased wear life and durability as compared to similar screen baskets previously known.

18 Claims, 4 Drawing Sheets

U.S. PATENT DOCUMENTS 5,094,360 3/1992 Lange .
5,110,456 5/1992 LeBlanc .
5,139,154 8/1992 Gero et al. .
5,285,560 2/1994 Gero et al. .
5,311,942 5/1994 Nagaoka .
5,433,849 7/1995 Zittel .
5,443,213 8/1995 Aikawa .
5,586,662 12/1996 Aikawa .
5,597,075 1/1997 Iwashige et al. .
5,599,449 2/1997 Gnamm et al. .
5,601,192 2/1997 Hutzler et al. .
5,601,690 2/1997 Gauld et al. .
5,605,234 2/1997 Aikawa .
5,607,587 3/1997 Langer .
5,607,589 3/1997 Frejborg .
5,611,399 3/1997 Richard et al. .
5,611,434 3/1997 Veh et al. .
5,618,422 4/1997 Pelkio .
5,618,424 4/1997 Nagaoka .
5,620,596 4/1997 Engdahl et al. .
5,622,267 4/1997 Hautala .
5,622,625 4/1997 Nagaoka .
5,624,558 4/1997 Aaltonen et al. .
5,624,560 4/1997 Voll et al. .
5,626,235 5/1997 Aikawa .
5,638,960 6/1997 Beuermann et al. .
5,643,458 7/1997 Nagaoka .
5,647,128 7/1997 Aikawa .
5,650,067 7/1997 Wilken-Trenkamp .
5,665,207 9/1997 Aikawa .
5,674,396 10/1997 Wenzl et al. .
5,679,250 10/1997 Larsson et al. .
5,711,879 1/1998 Carlson .
5,718,826 2/1998 Frejborg .
5,727,316 3/1998 Reindeau .
5,738,787 4/1998 Alexander et al. .

MODULAR SCREEN CYLINDER AND A METHOD FOR ITS MANUFACTURE

BACKGROUND OF THE INVENTION

1. Field of the Invention

The present invention relates to a screen cylinder intended for use in screening wood pulp and other fibrous fluid suspensions for removing foreign particles from a pulp slurry, and a method for manufacturing the apparatus. More particularly, the apparatus and method relate to rebuildable screen cylinders for screening thick stock or thick pulp slurry within the pulp and paper industry. Still more particularly, the apparatus and method relate to improved screen cylinders that are less expensive to manufacture and provide increased wear life and durability as compared to similar screen baskets known heretofore.

2. Description of the Prior Art

Screens are used to separate acceptable papermaking fiber from unacceptable constituents of a slurry of pulp fiber in preparing the wood fiber for the papermaking process. In typical wood pulp screens, a slurry of pulp flows through a perforate cylindrical screen plate or basket which may be smooth, or which may have a contoured surface facing toward the stock flowing through the screen cylinder. The screen plate openings are formed in different hole or hole and slot combinations for optimizing screening performance. To aid in passage of the acceptable pulp through the screen plate, and to avoid plugging, pulsations are generated in the slurry such as by passing a hydrofoil-shaped member or rotor past the screen plate. Screen cylinders used in pulp and paper mills are subjected to heavy pressure loads. To provide sufficient strength to a screen cylinder or a screen plate, which generally is a basket-shaped member surrounding a rotor, so that it can withstand the pressures experienced in a pressurized screen cylinder, it has been the accepted practice to provide thick-walled screen plates or baskets which are machined to present the desired screening surface, or thin-walled formed screen plates or baskets with reinforcing rods.

A thick-walled screen cylinder is described in U.S. Pat. No. 3,664,502. Screen cylinders of the type described in this patent are formed of a metal plate rolled and welded in tubular form and provided with a multiplicity of screening openings. To withstand the pressures involved, relatively heavy gauge metal is used, such as ⅛" to 5/16" stainless steel. When the screen plate of the type described in this patent is rolled into tubular form, a weld seam is used to connect the ends of the metal plate. In order to perform the welding operation, a welding fixture must be utilized to hold the rolled screen plate in proper position to perform the weld. The weld seam leaves a rough, abrasive surface on the inside diameter of the rolled screen plate. Left as is, the weld seam would drastically affect the screening surface of the screen plate and reduce the effectiveness and efficiency of the screening operations. As a result, screens of this type that are rolled and welded into tubular form must undergo grinding operations to smooth out the interior surface of the screen plate. After the grinding operations, the screen cylinder is machined in the round or rolled condition to provide a finished interior surface.

In addition to the expensive costs of production and manufacturing, in large part due to the lengthy welding and grinding procedures, the type of one-piece screen described above has been expensive to use and maintain in that, even if only a small area of screen is damaged, the entire screen plate, which includes the screening surface, mounting bodies and support members must be replaced, thereby presenting a costly operating experience.

An improvement to the solid, one-piece, thick-walled screen is described in U.S. Pat. No. 4,264,438. The screen cylinder or drum according to this patent is assembled into cylindrical form by using a plurality of adjacent cylindrical screen members spaced apart, between which a stiffening ring is disposed. The cylindrical screen members and the stiffening ring are attached to each other by a weld joint connecting a projecting part of the stiffening ring and the ends of the cylindrical screen members and filling the gap between them. As with the prior art screen described in U.S. Pat. No. 3,664,502, because of the welding operations needed to connect the ends of the screen members and the screen members to the rings, welding fixtures are necessary to hold the screen assembly in proper position. The numerous weld seams must be ground smooth on the interior surface of the screen so as not to disturb the screening operations, and finish machining is also required. The lengthy welding and grinding operations to this prior art screen cause slot and hole distortion in the heat affected zones of the screening media. Because of the welding stresses that occur in the welds connecting the cylindrical screen members and the stiffening rings, the teaching of the patent for this prior art screen provides that the ends of the cylindrical screen members should be expanded before welding by the same amount as they are contracted by the welding stresses. As a result, manufacturing a screen drum according to the method described in U.S. Pat. No. 4,264,438, is extremely costly and time consuming.

The prior art screens described above require that the screen cylinder ends be seam welded when rolled into cylindrical form. This manufacturing method of construction leads to screen failure at the welded seam when the screen is used under normal operating conditions. The welded seam joint constrains the cylinder screen in the round condition under mechanical stress, and the welding process induces thermal stresses in the screen at locations near the weld seam. The weld seam creates a heat-affected zone at and near the seam which becomes very brittle. Thus, under normal operating conditions, the screen is subject to failure at or near the weld seam. To help overcome these problems, stress relieving is performed in one of two ways to prevent or reduce the stresses introduced into these prior art screens. The first method involves vibratory stress conditioning of the screen, and the second method involves thermal stress relieving the screen by heat treatment. However, internal stresses of the nature created in manufacturing these prior art screens are not always successfully stress relieved by the above methods, and, as a result, the potential for failure is not eliminated; and it has been observed in prior art screen cylinders that fractures tend to occur along the welded seam and heat-affected zones even under normal operating conditions.

U.S. Pat. No. 4,954,249 describes an improved screen over the screens described above as used in the pulp and paper industry. Beloit Corporation sells and markets screen cylinders according to this patent under the trademark BelWave™. The modular screen plate structure of Beloit's BelWave™ screen simplifies screen plate changing and eliminates the need to change an entire screen plate when only a portion of the plate is damaged or worn. One of the features of Beloit's BelWave™ screen plate is utilizing corrugated, thin-walled screen material in order to avoid the attendant difficulties of machining thick-walled screen plates and to reduce the cost associated with manufacturing thick-walled screen plates. The modular, cylindrically-shaped screens also reduce the number of welding operations needed to create cylindrical screens by positioning and connecting modular screen sections into grooves located in support rings. The modular screen sections are formed into a corrugated pattern and then rolled into cylindrical form. One end of the corrugated screen plate section overlaps the other end of the corrugated section and a weld seam is not required to hold the ends together because the corrugated thin-walled section is pressed into the grooves located in adjacent support rings.

Although Beloit's BelWave™ screen cylinder has been and continues to be an improved screen plate for the pulp and paper industry, in certain thick stock or slurry screening operations, the thin, corrugated screening media is subject to impact failure.

What is needed is a screen cylinder that utilizes the benefits of Beloit's Modular BelWave™ screen cylinder construction and yet is capable of withstanding the high pressure and wear due to contaminants encountered in thick slurry environments and, at the same time, eliminate the disadvantages and problems associated with manufacturing screens of the types described above.

SUMMARY OF THE INVENTION

A novel, modular, thick-walled, smooth or contoured screen cylinder and a method of manufacturing this screen cylinder is described below. The thick-walled, smooth or contoured surface screen cylinder is capable of withstanding the destructive elements found in thick slurry pulp and paper screening environments. The problems associated with using a weld seam for a screen cylinder or section where rolled ends of the screen cylinder or section meet has been obviated by the present invention. A lap joint according to the present invention is used to connect the ends of a screen cylinder or section when the screen is rolled into cylindrical shape. The lap joint is machined into the ends of the screen cylinder or section before it is rolled into final form. The lap joint connection eliminates any need to weld the ends of the screen cylinder or section together; which, consequently, eliminates any grinding or machining operation on the inside surface of the screen after it has been rolled into cylindrical shape. Additionally, because the lap joint allows for an overlapping floating design, tight manufacturing tolerances needed for prior art screens are eliminated.

Accordingly, it is a feature of the present invention to eliminate the weld joint or seam used to connect ends of a rolled screen cylinder or section. The nonwelded construction of the screen will prevent any slot and hole distortion encountered in the heat zones of the currently used welded screens. The nonwelded construction of the screen also improves operational strength and eliminates failures that are associated with welded screen cylinders.

A further feature of the invention is that the lap joint does not constrain the screen cylinder or section after rolling, which in turn reduces the mechanical stresses induced into prior art screen cylinders from the current rolling and welding operations. Furthermore, the lap joint of the current invention is beneficial in that it eliminates the heat-affected zone created by the prior art welding operations and all of the thermal stresses associated with prior art welding operations.

A still further feature of the invention is to eliminate expensive weld fixtures currently necessary in order to assemble screens as described herein.

An additional feature is to eliminate costly grinding operations utilized in manufacturing screen cylinders because of current welding processes. Eliminating welding operations conducted on or near the interior surface of a screen eliminates grinding and finish machining operations on the interior surface of the screen.

Another feature is to reduce high-tolerance machining operations in connection with manufacturing screen cylinders.

Yet another important feature of the novel screen cylinder described herein is that it is capable of withstanding the destructive environments found in thick slurry or pulp screening applications in the pulp and paper industry.

A still further feature of the screen cylinder according to the present invention is that when used as a replacement for earlier modular designs, the novel screen cylinder provides greater capacity in the same screen apparatus.

These, and other features and advantages of the present invention will become readily apparent to those skilled in the art upon reading the description of the preferred embodiments, in conjunction with the attached drawings.

DESCRIPTION OF THE PREFERRED EMBODIMENTS

Figure 4:
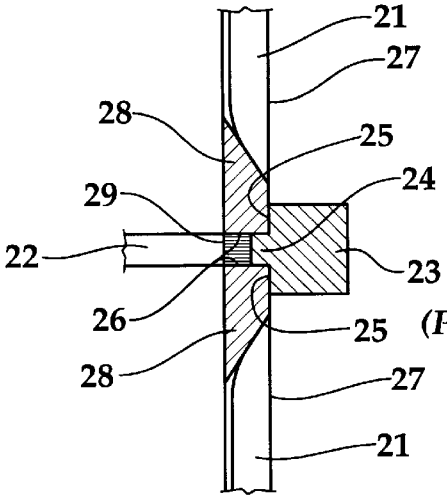
Fig.4 (PRIOR ART)
FIG. 4 is an enlarged, fragmentary view of the region designated "4" in FIG. 3.
Figure 5:
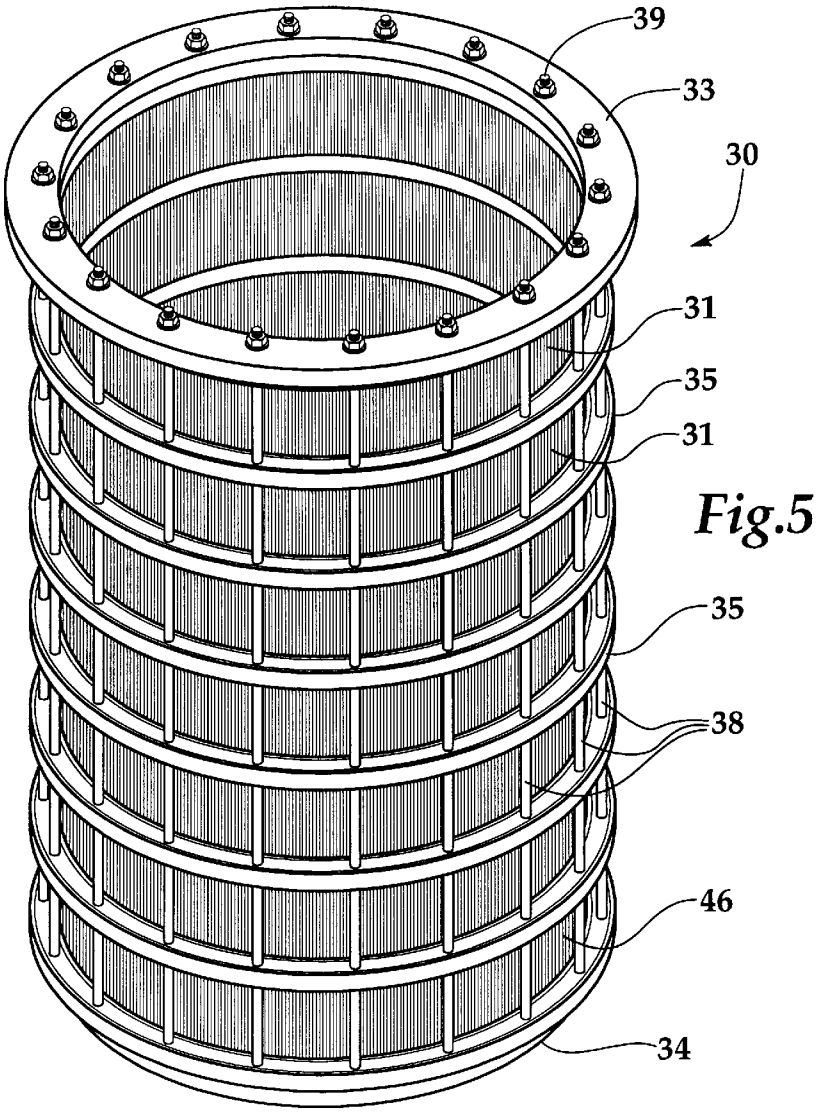
FIG. 5 shows a screen cylinder according to the present invention.
Figure 8:
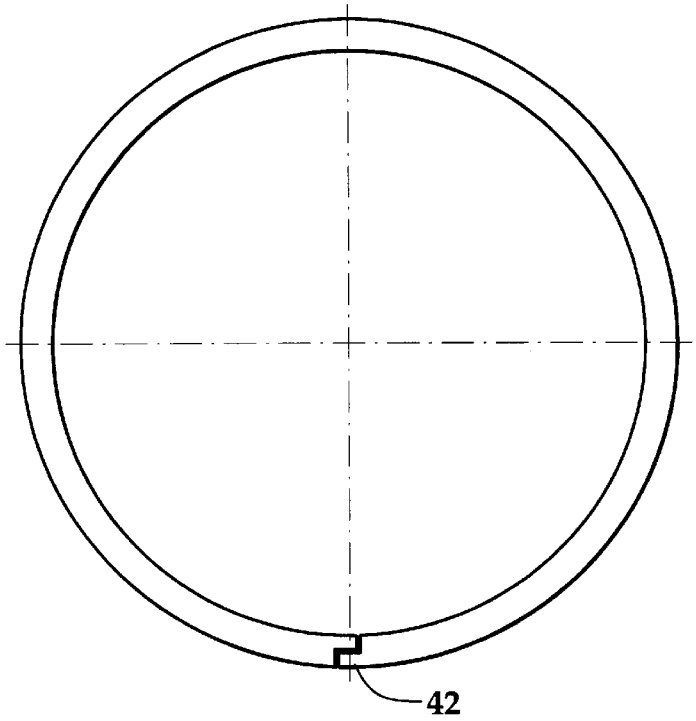
FIG. 8 is a top cross-sectional view of a rolled screen section depicting the lap joint according to the invention.

FIG. 5 shows a screen cylinder according to the present invention. FIG. 8 shows a lap joint 42, described more fully below, as used in the screen cylinder of the present invention. Screen cylinders of the type described according to the present invention that utilize the lap joint 42, shown in FIG. 8, are intended to replace the prior art screens described in FIGS. 1–4.

Figure 1:
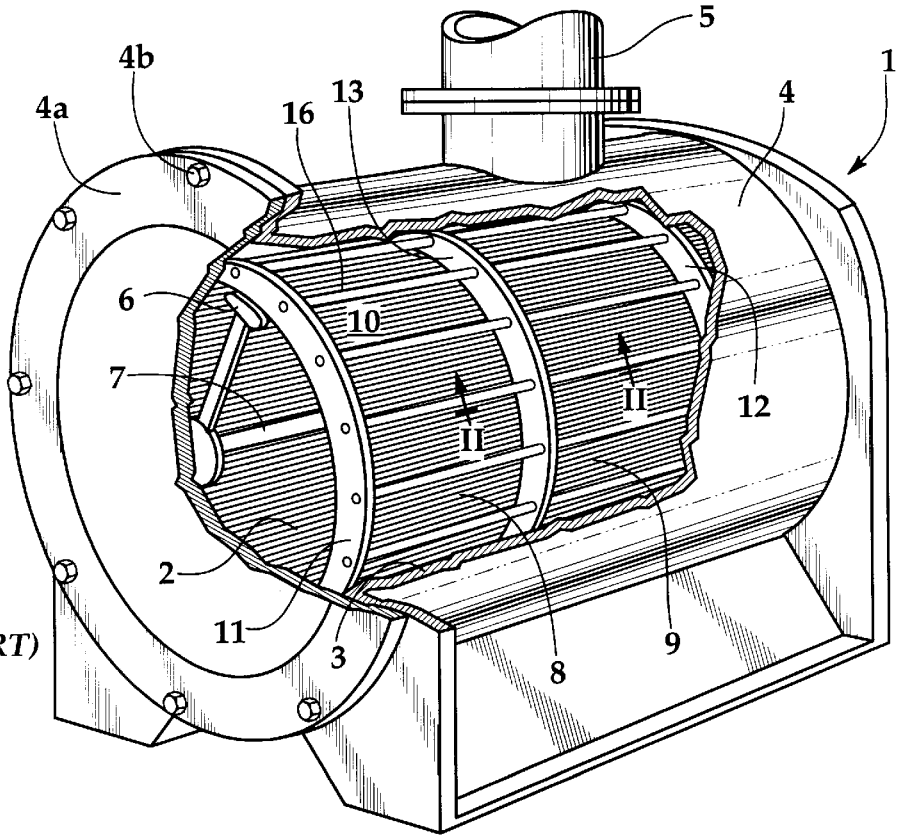
Fig.1 (PRIOR ART)
FIG. 1 is a perspective view, with portions broken away, illustrating a screening apparatus having a prior art modular cylindrical screen cylinder sold by Beloit Corporation under the trademark BelWave™.

FIG. 1 illustrates a prior art screening apparatus 1 wherein previously treated pulp is screened to remove foreign elements such as sheaves, bark, knots, particles of wood, dirt, glass, plastic and the like.

A screen plate assembly is shown at 10, defining in the apparatus 1 an interior chamber 2 where the pulp to be screened flows in and an exterior chamber 3 where the screened pulp flows out after passing through the screen plate assembly. The assembly is enclosed in a housing 4 which has an inlet (not shown) for the entrance of pulp to be screened into the chamber 2, and an outlet (not shown)

leading from the chamber 2 for the foreign material such as the sheaves, bark and dirt. The accepted pulp flows out through an outlet 5.

The screen plate assembly 1 is stationary within the housing 4, and for aid in passing the liquid stock with pulp through the screen plate, and to help inhibit plugging, hydrofoils 6 are mounted for rotation within the cylindrical screen plate assembly. The hydrofoils 6 are supported on arms of a rotary driven shaft 7, and rotate in a clockwise direction, as viewed in FIG. 1. The hydrofoils shown are merely illustrative of a suitable type, and it should be understood that the present invention can be used for screen plates of various types for various pulse, turbulence and combination pulse and turbulence generating rotors.

The prior art screen plate assembly 1 includes cylindrical, thin-walled, corrugated screen sections 8 and 9 which, without support, are essentially flexible and require rigidifying or strengthening for use in the pressurized environment of screen apparatus 1. The necessary support and strengthening is provided by end rings 11 and 12 and an intermediate support ring 13. Each of the rings has grooves such as illustrated by the grooves 14 and 15 in the ring 13 shown in FIG. 2. The grooves 14 and 15 are circular to hold the screen sections in a substantially cylindrical shape. The grooves 14 and 15 have a radial dimension substantially equal to the radial thickness of the shaped screen plates.

The screen plates according to this prior art device are formed from relatively thin material formed in various shapes or contours. During assembly, each of the shaped screen plates is positioned into the grooves in the end rings 11 or 12 and the intermediate ring 13, and the rings are pulled together to force the screen plates into the grooves 14 and 15. For this purpose, axially extending rods 16 are provided, spaced circumferentially from each other, and the rods are provided at their ends with threads and nuts 17 so that the nuts can be tightened to pull the end rings toward each other and force the ends of the screen plates into the respective grooves. The grooves 14 and 15 are tapered so that the slot becomes narrower in an inward direction toward the bottom of the grooves, as indicated by the illustration shown in FIG. 2. When the rods are tightened, the screen plates are pushed tightly into the tapered grooves so that the screen plates are held firmly in a fixed, circumferential position. With screen assemblies of different lengths, the screens can be longer or shorter, and additional reinforcing intermediate rings such as 13 may be employed between the ends of each of the adjacent screens.

Figure 2:
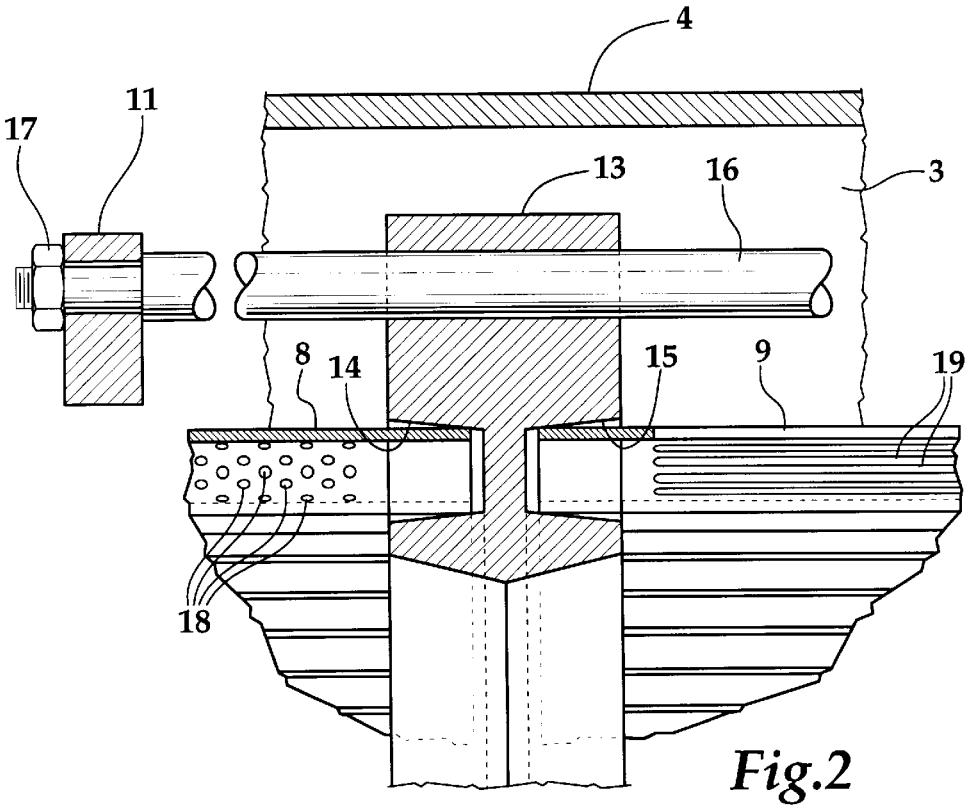
Fig.2 (PRIOR ART)
FIG. 2 is an enlarged fragmentary, sectional view taken substantially along line II—II of FIG. 1.

Screening openings such as 18 and 19 extend through the thin-walled, corrugated prior art screen material, as shown in the screen sections 8 and 9 in FIG. 2. Depending upon the types of stock to be screened and the specific problems of screening, different combinations of slots or holes may be employed, and the thin material used in this prior art screen plate assembly can be provided with holes or slots of different sizes and shapes through various manufacturing techniques.

If wear or damage to any of the prior art cylindrical screen sections 8 or 9 occurs, the damaged section can be replaced by loosening the axial tie rods and replacing or exchanging the damaged section. This also enables replacement with substitute sections of different hole or slot arrangements so that, with a given piece of screening machinery, different screening operations can be achieved through easy replacement of screen sections. As will be seen from the drawing of FIG. 1, access to the interior of the housing 4 is readily afforded by removal of the end plate 4*a* through removal of the bolts 4*b*. This permits withdrawal of the screen assembly for ready exchange or replacement of the screen sections.

Before assembling the prior art cylindrical screen plate assembly 10 of FIG. 1, the screen sections 8 and 9 are formed into a variety of undulated patterns by simple bending and forming techniques, as described in U.S. Pat. No. 5,023,986.

Figure 3:
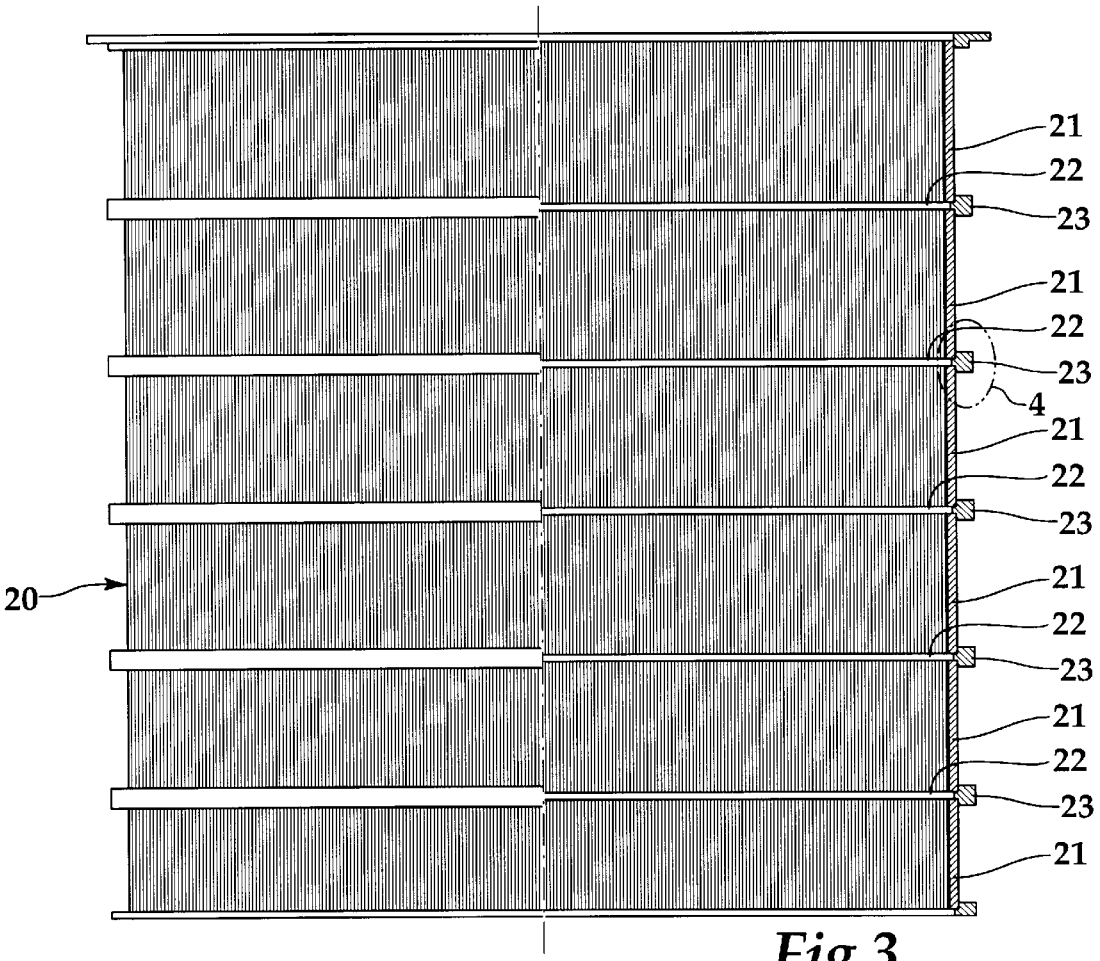
Fig.3 (PRIOR ART)
FIG. 3 is a side view, partly in section, of another prior art screen cylinder.

FIGS. 3 and 4 show another prior art screen cylinder or drum 20 that comprises a plurality of adjacent cylindrical screen members 21 between which there is a gap 22. In the screen drum, there are a plurality of stiffening rings 23 spaced apart, which have been fitted with a flange-like projecting part 24 that extends between end surfaces 26 of the cylindrical screen members. Cylindrical surfaces 25 of the stiffening ring 23 are of the same size or slightly larger in diameter than the outer surface 27 of the cylindrical screen member so that, when assembling a screen drum, they can function as guiding surfaces for the ends 28 of the cylindrical screen member. The cylindrical screen members and the stiffening ring are attached by a weld joint 29, connecting the projecting part of the stiffening ring and the ends of the cylindrical screen member and filling the gap between the cylindrical screen members.

FIG. 5 illustrates a modular, thick-walled screen cylinder 30 according to the present invention that is an improvement to the screen cylinders shown in FIGS. 1–4. Additionally, the screen cylinder of the present invention can be used as a replacement for prior art screen cylinders in most common pulp and paper screen apparatuses. The screen cylinder 30 fits into a screening apparatus housing having similar inlets and outlets as those described for the screening apparatus 1 shown in FIG. 1. Also, a hydrofoil and drive shaft similar to that used in the screen of FIG. 1 is used for the screen cylinder of the present invention.

The modular screen cylinder of the present invention includes cylindrical screen sections 31 which are made from smooth or contoured, relatively thick, polished 316 stainless steel or other suitable alloy. Occasionally, if the environment requires it, the screen sections or media 31 are chrome plated to provide further wear and corrosion resistance. The screen sections 31 can have a variety of hole or slot sizes and/or various contours.

Figure 9:
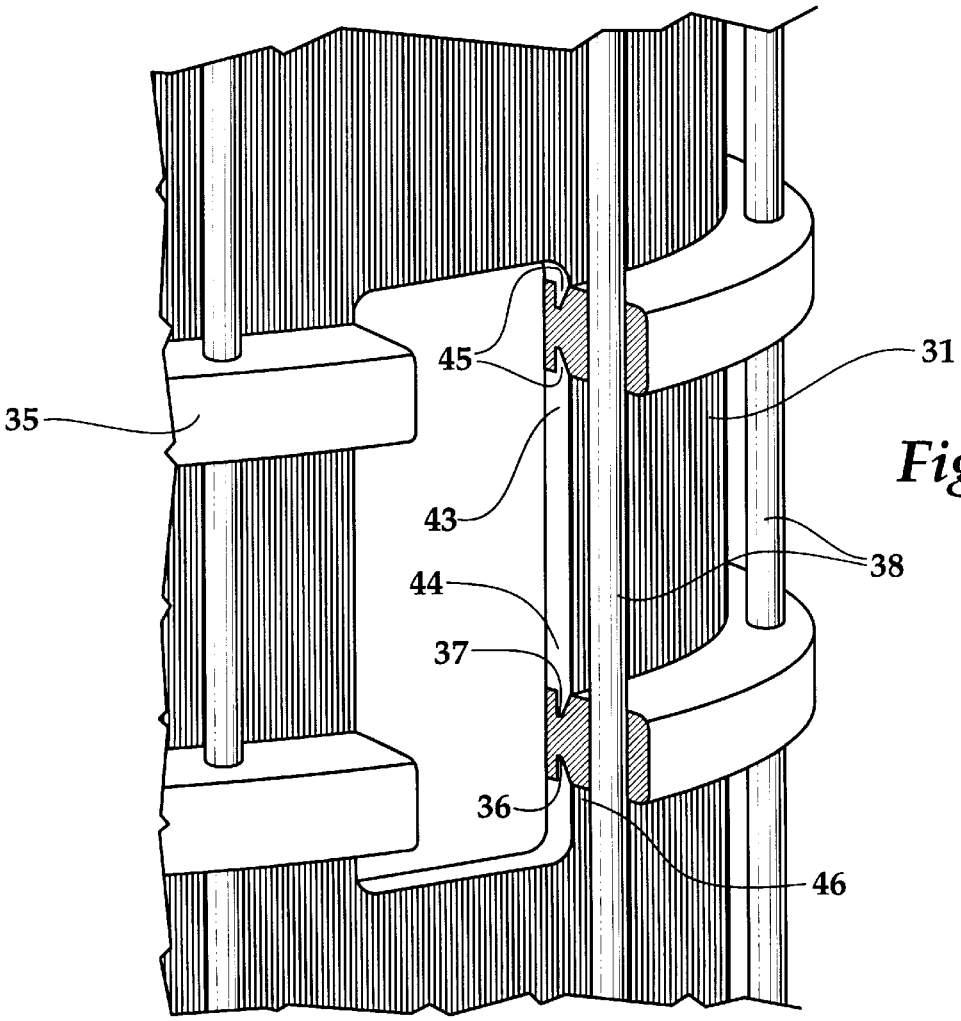
FIG. 9 is a perspective view of the screen cylinder of FIG. 5, with portions broken away, illustrating details of the assembly of one embodiment according to the present invention.

The modular screen cylinder 30 includes end rings 33 and 34 and intermediate support rings 35. To provide enhanced durability, the screen cylinder support rings 35 are made of 17-4ph stainless steel, and treated to C-40 material specification, but can also be made from other suitable alloys. As shown in FIG. 9, each of the support rings 35 has grooves 36 and 37. End rings 33 and 34 each have a groove which is similar to the grooves 36 and 37 of support ring 35. The grooves 36 and 37 are circular to hold the screen sections in substantially cylindrical shape.

During assembly, each of the shaped screen sections 31 is positioned into the grooves 36 and 37 of the respective rings. In one embodiment, the modular screen cylinder assembly 30 is pulled together to position the screen sections into the grooves. For this purpose, axially extending stainless steel tie rods 38 are provided, spaced circumferentially from each other, and the rods are provided at their ends with threads and nuts 39 so that the nuts can be tightened to pull the end rings toward each other and force the ends of the screen sections into the respective grooves. In another embodiment (not separately shown), tie rods are not used; rather, screen sections 31 are held firmly in place via grooves 36 and 37 by welding the outside surface 46 of the screen sections 31 to the support rings 35 or end rings 33 or 34. Importantly, the minimal amount of welding necessary on the outside surface of the screen in order to firmly hold the screen cylinder together, does not affect the inside screening surface and does not induce any significant amount of thermal stresses into the screen section. Eliminating the weld used on the inside of a cylinder to hold it together eliminates the need to grind and finish machine the inside surface of the screen as is currently done in prior art screen cylinders.

Figure 6:
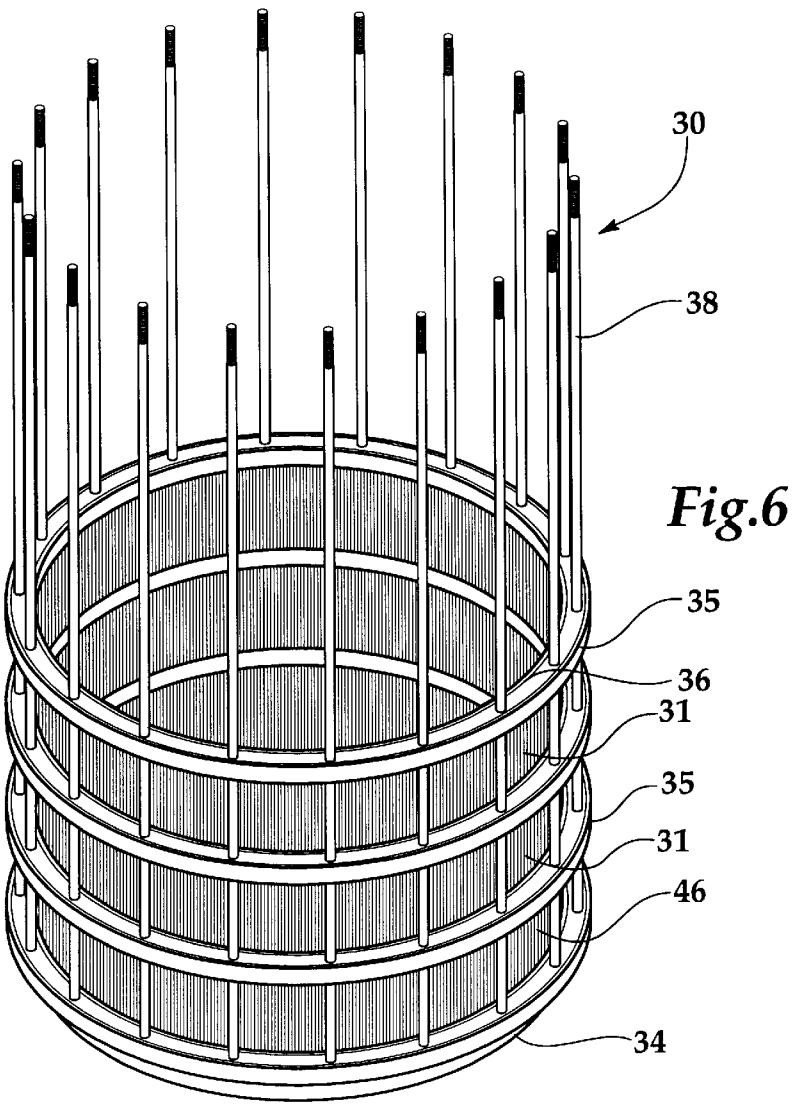
FIG. 6 shows a partially assembled screen cylinder of the present invention.

FIG. 6 shows a partially assembled screen cylinder according to the present invention. Screen sections 31 fit into the grooves 36 and 37 and are stacked one on top of the other until a complete cylindrical screen is formed. Tie rods 38 hold the screen cylinder 30 together. As previously mentioned, in another embodiment, the tie rods 38 are not used; rather, the sections 31 are welded directly to the rings.

Figure 7:
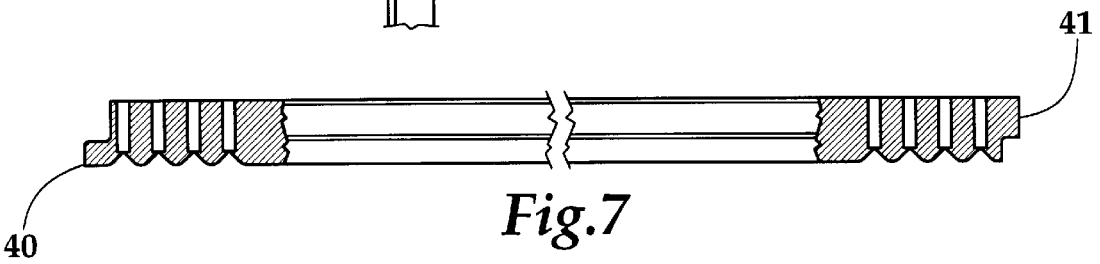
FIG. 7 is a cross-sectional detail of a screen section lap joint according to the present invention.

FIG. 7 shows a cross-section of a screen section 31 before it is rolled into cylindrical shape. Ends 40 and 41 of the section 31 contain a machined joint that, when fitted together in a rolled shape, form a lap joint 42, as shown in FIG. 8, according to the present invention. The lap joint 42 is of a floating design, meaning that when the screen section 31 is rolled into cylindrical form, it will align itself circumferentially with the rings. The rings are formed into cylinder shape. Screen sections 31 will conform to the cylindrical shape of the rings when fitted into the grooves of the rings because of the floating design of the lap joint 42.

FIG. 9 shows a partially broken away section of screen section 31 and further depicts how the screen sections fit with the grooves of the rings. The screen section 31 has top and bottom portions 43 and 44. The top and bottom parts have ring groove ears 45. The groove ears 45 fit into the grooves 36 and 37 of the rings 35, or rings 33 or 34, when assembled together. Although the groove ears and grooves are shown with particular shapes, e.g., tongue and groove connection, the groove ears and grooves can be of many different shapes and sizes.

The prior art screen shown in FIG. 1 is assembled in the following manner. First, the screen sections are machine drilled or slotted while in a flat configuration or formed through mechanical bending and shaping. Once the sections are drilled, slotted or formed, the individual screen sections are rolled into cylindrical shape. After the sections are rolled, if necessary, the ends of the sections are machined so they will fit into the grooves of the rings. After the screen sections are formed, the screen cylinder is assembled by placing the sections into the grooves of the rings stacking one section on top of another. Because the grooves are of a tapered design, in order to snuggly fit the ends of the sections into the grooves and bottom out the ends of the sections in the grooves, a 100-ton press is used to force the screen media into the grooves. Tie rods are used to firmly hold the screen cylinder assembly together.

The prior art screen shown in FIG. 3 is assembled in the following manner. First, the holes or slots are drilled or machined into the section while the section is in a flat configuration. The section is then rolled into cylindrical form. Once rolled, a welding fixture is utilized in order to hold the section together while the ends of the section are seam welded together. The screen sections are assembled one on top of the other by connecting each section to each other via the use of a stiffening ring and a weld. Once all the welding operations are finished, the inside surface of the screen cylinder must be ground and finish machined.

The welding and grinding operations of prior art screens create heat affected zones and the holes or slots are affected by the heat generated, thereby preventing efficient screening media and reducing the overall area of the screening surface. Additionally, the heat-affected zones represent possible failure sites of these prior art screens. Furthermore, the Bel-Wave™ screen shown in FIG. 1 is not particularly suited for screening thick, heavily contaminated pulp because the sections are subject to impact failure due to the fact that this screen uses thin-walled, corrugated screen sections.

The modular screen cylinder of the present invention utilizes thick, smooth or contoured screen sections and eliminates welding the ends of screen sections together. Eliminating the weld seam eliminates the need for welding fixtures, inside diameter grinding operations and finish machining procedures of prior art screens. Because welding the seams is eliminated, the drilled or slotted holes are not affected, which provides for an improved screening surface. All of which greatly reduces the overall cost associated with manufacturing screen cylinders. Even more importantly, eliminating the weld seam improves the operational strength of the screen cylinder and eliminates the possibility of screen cylinder failures at or near a weld seam.

According to the invention, all machining to a screen cylinder section 31 is performed while the screen media is in a flat configuration. This includes slotting, drilling, surface contouring, but most importantly, the lap joint shown in FIGS. 7 and 8 and the groove ears 45 shown in FIG. 9 are machined into the section while the material is flat. Because the weld seam is eliminated, the modular screen assembly according to the present invention eliminates the need for special weld fixtures which are required to hold individual screen media and rings together during the welding process for the present prior art conventional screen cylinders. The screen media has groove ears 45 machined onto the screen sections 31, and the rings are machined with mating grooves 36 and 37, as shown in FIG. 9. After the screen media are rolled, the screen media groove ears are then placed into the mating ring grooves as shown in FIGS. 6, 7 and 9. This is repeated until the entire screen assembly has been stacked to its finished size, see FIGS. 5 and 6. The ring grooves 36 and 37 work as integral devices which lock and hold the screen media in place to the exact inside screen cylinder diameter specifications. The modular screen has no inside diameter welding at the groove ears and groove interface, and all parts are machined to their finished dimensions prior to assembly. Therefore, all finish grinding and finish machining on the inside diameter of the screen cylinder are eliminated.

Lap joint ends 40 and 41, according to the present invention, are machined in the flat as shown in FIG. 7 on opposing sides of a screen section. The lap joint creates an overlapped mechanical joint when the screen section is rolled into a cylinder shape as shown in FIG. 8. This overlapping mechanical lap joint allows for ease of assembly because of the tolerances associated with generating the lap. All welding is eliminated at the inside diameter of the screen media seam. Thus, this eliminates any need to grind the inside diameter to ensure proper finished dimensions and surface finish. Because the lap joint is a floating design joint, this allows for less costly machine tolerances. The lap joint is designed with enough tolerance for slippage or movement so that rolled screen media will expand or contract as needed to properly locate itself, cylindrically, with the grooves of the respective rings. The inside diameter of the ring groove is the controlling factor for the finished screen cylinder's inside dimensions. The lap joint will remain fixed once the screen media sections are placed into the captive ring grooves. After the cylinder is completely assembled, the tie rods hold the assembly together. Because of the shape of the grooves and groove ears, assembly can be accomplished without the use of a large press machine, as is needed with Beloit's BelWave™ design. In those applications where tie rods are not necessary, the outside surface of the screen sections can be lightly welded to the support rings. These light welds are unlike the large weld seam of the prior art screens. The small amount of welding necessary to connect the outside surface of the screen section to the support ring will not induce any significant amount of thermal stresses into the screen, unlike the large weld seam of the prior art screens which induces a significant amount of thermal stresses into the screens. These welds will not affect the inside screening surface of the cylinder. As a result, these welds will not require the cylinder to be further finish ground or machined.

The system of interchangeable cylindrical screen members is essential to modular screen technology. The screening media section is a replaceable hoop that fits securely into a groove in a support ring. High strength stainless steel tie rods hold the cylinder together in one embodiment of the invention. Damaged hoops can be replaced one at a time for a fraction of the cost of replacing the entire cylinder. The screen cylinder frame of rings and tie rods can be reused again and again. The modular screen section allows the use of varying screen media within a single cylinder. For example, because the concentration of large debris increases as flow moves further down the cylinder, greater spacing between the screening holes toward the cylinder's outlet end allows for avoiding plugging and keeping the screen apparatus operating smoothly. Additionally, because of the nonwelded construction, the slotted cylinders have approximately 5 percent more open area than conventional cylinders, resulting in increased screening capacity. The precise tongue and groove connection between the screening media hoop and the support rings ensures a solid seal between components.

While an apparatus and method for a modular screen section has been shown and described in detail, herein, various changes may be made without departing from the scope of the present invention.

We claim:

1. A modular pulp slurry screen cylinder assembly for use in screening pulp slurry, the pulp slurry to be screened being fed to one side of said screen cylinder assembly, with some of the pulp slurry flowing through said screen cylinder to the opposite side thereof, said modular screen cylinder assembly comprising:

a cylindrically-shaped, rolled metallic screen section having openings therethrough and a front end and a back end; said cylindrically-shaped screen section further comprising top and bottom portions, said top and bottom portions having groove ears;

rigid cylindrical end rings disposed at opposite ends of said modular screen cylinder, said end rings having grooves therein, said grooves being adapted for receiving said respective groove ears in said cylindrically-shaped screen section;

a nonwelded and axially-extending lap joint formed from said front end and said back end of said cylindrically-shaped screen section connecting said front end and said back end of said screen section; and wherein said cylindrically-shaped screen section is formed of a single sheet.

2. A modular screen cylinder assembly as recited in claim 1, further comprising axially extending tie rods disposed between said end rings, fixing said end rings in location relative to each other, and securing said cylindrically-shaped screen section in the grooves of the end rings.

3. A modular screen cylinder assembly as recited in claim 1, wherein said cylindrically-shaped, rolled screen section is formed of a thick-walled, smooth sheet material.

4. A modular screen cylinder assembly as recited in claim 1, wherein said cylindrically-shaped, rolled screen section is formed of a thick-walled, contoured sheet material.

5. A modular screen cylinder assembly for use in screening pulp slurry, the pulp slurry to be screened being fed to one side of said screen cylinder assembly, with some of the pulp slurry flowing through said screen to the opposite side thereof, said modular screen cylinder assembly comprising:

at least two cylindrically-shaped, rolled screen sections having openings therethrough and a front end and a back end; said cylindrical screen sections further comprising top and bottom portions, the top and bottom portions having groove ears;

at least one intermediate support ring disposed between said at least two cylindrically-shaped screen sections, said at least one intermediate support ring including grooves therein, the grooves being adapted for receiving the respective groove ears of the cylindrically-shaped screen sections;

rigid cylindrical end rings disposed at opposite ends of said modular screen cylinder, said end rings having grooves therein, the grooves being adapted for receiving the respective groove ears of the cylindrically-shaped screen sections;

a nonwelded lap joint formed from the front end and the back end of each of said cylindrically-shaped screen sections connecting the front end to the back end of said screen section;

wherein said nonwelded lap joint extends generally axially relative to said modular screen cylinder; and wherein each of said cylindrically-shaped screen sections is formed of a metal having a thickness of between 1/8 inch and 5/16 inch.

6. A modular screen cylinder assembly as recited in claim 5, wherein said at least one intermediate support ring further contains holes therethrough; and further comprising axially extending tie rods disposed between said end rings, said tie rods circumferentially lining up and sliding through said holes in said at least one intermediate support ring, said axially extending tie rods fixing said end rings in a location relative to each other and securing said cylindrically-shaped screen sections in said grooves in said end rings and at least one intermediate support ring.

7. A modular screen cylinder assembly as recited in claim 5, wherein each of said cylindrically-shaped, rolled screen sections are formed of a single smooth metal sheet of one-piece construction.

8. A modular screen cylinder assembly as recited in claim 5, where said cylindrically-shaped, rolled screen sections are formed of a contoured sheet.

9. A modular screen cylinder as recited in claim 1 wherein said cylindrically-shaped screen section is comprised of a single perforate metal sheet that is not corrugated.

10. A modular screen cylinder assembly as recited in claim 1, wherein said cylindrically-shaped, rolled screen section is formed having a thickness between 1/8 of an inch and 5/16 of an inch.

11. A modular screen cylinder for screening a pulp slurry having a pair of spaced apart ends comprising:

a plurality of generally cylindrical screen cylinder sections, wherein each of said screen cylinder sections 1) is formed of a single sheet of perforate metal having a thickness of between 1/8 of an inch and 5/16 of an inch, 2) has a pair of axial edges, and 3) has a pair of axially-extending ends that overlap to form an axially-extending lap joint without being joined;

a plurality of axially spaced apart intermediate rings with each of said intermediate rings operably cooperating with 1) one of said axial edges of one of said screen cylinder sections to help hold said one of said screen cylinder sections in a generally cylindrical shape and 2) one of said axial edges of another one of said screen cylinder sections to help hold said another one of said screen cylinder sections in a generally cylindrical shape;

a plurality of spaced apart end rings with one of said end rings disposed at one of said ends of said modular screen cylinder and the other one of said end rings disposed at another one of said ends of said modular screen cylinder;

a plurality of pairs of circumferentially spaced apart tie rods that are received through said intermediate rings and said end rings and that urge said intermediate rings, said end rings, and said screen cylinder sections together;

a movable foil disposed interiorly of said screen cylinder sections; and a housing surrounding said screen cylinder sections, said intermediate rings, said end rings, said tie rods, and said movable foil wherein said housing has an inlet through which the pulp slurry is admitted and an outlet through which a pulp slurry filtrate is discharged.

12. A modular screen cylinder assembly as recited in claim 11 wherein, for each of said screen cylinder sections, one of said axially extending ends of each said screen cylinder section has a groove for receiving a part of the other one of said axially extending ends of each said screen cylinder section and the other one of said axially extending ends of each said screen cylinder section has a groove for receiving a part of the one of said axially extending ends of each said screen cylinder such that an inner surface of each said screen cylinder section adjacent one of said axially extending ends is substantially flush with said inner surface of each said screen cylinder section adjacent the other one of said ends.

13. A modular screen cylinder assembly as recited in claim 11 wherein each of said intermediate rings have a channel therein for receiving one of said axial edges of one of said screen cylinder sections that helps hold said one of said screen cylinder sections in a generally cylindrical shape.

14. A modular screen cylinder assembly as recited in claim 13 wherein each of said axial edges has a portion that is thinner than the thickness of said screen cylinder section.

15. A modular screen cylinder assembly as recited in claim 14 wherein each said channel is tapered so as to engage said thinner portion of one of said axial edges of one of said screen cylinder sections.

16. A modular screen cylinder assembly as recited in claim 11 wherein each of said screen cylinder sections is comprised of stainless steel.

17. A modular screen cylinder assembly as recited in claim 11 wherein said lap joint is not welded.

18. A modular screen cylinder assembly as recited in claim 11 wherein said lap joint is not mechanically joined.

* * * * *